US009478199B1

(12) United States Patent
Duncan

(10) Patent No.: US 9,478,199 B1
(45) Date of Patent: Oct. 25, 2016

(54) STRINGED INSTRUMENT HEMISPHERICAL PULL STRING TENSIONER

(71) Applicant: Christopher G Duncan, Medford, OR (US)

(72) Inventor: Christopher G Duncan, Medford, OR (US)

(73) Assignee: Christopher G. Duncan, Medford, OR (US)

( * ) Notice: Subject to any disclaimer, the term of this patent is extended or adjusted under 35 U.S.C. 154(b) by 2 days.

(21) Appl. No.: 15/016,279

(22) Filed: Feb. 5, 2016

(51) Int. Cl.
*G10D 3/14* (2006.01)

(52) U.S. Cl.
CPC ..... *G10D 3/14* (2013.01)

(58) Field of Classification Search
CPC ..... G10D 3/14
See application file for complete search history.

(56) References Cited

U.S. PATENT DOCUMENTS

| | | | | | |
|---|---|---|---|---|---|
| 2,519,824 | A * | 8/1950 | Cousineau | G10D 3/14 | 84/312 R |
| 4,366,740 | A * | 1/1983 | Tripp | G10D 3/04 | 84/197 |
| 4,452,120 | A * | 6/1984 | Chance | G10D 3/14 | 84/306 |
| 4,608,904 | A * | 9/1986 | Steinberger | G10D 3/14 | 84/205 |
| 4,649,789 | A * | 3/1987 | Wadatsu | G10D 3/14 | 84/297 R |
| 4,672,877 | A * | 6/1987 | Hoshino | G10D 3/12 | 84/267 |
| 4,674,387 | A * | 6/1987 | Caruth | G10D 3/14 | 84/208 |
| 5,018,424 | A * | 5/1991 | Steinberger | G10D 3/14 | 84/304 |
| 5,097,736 | A * | 3/1992 | Turner | G10D 3/14 | 24/71.1 |
| 5,277,095 | A * | 1/1994 | Steinberger | G10D 3/14 | 84/304 |
| 5,589,653 | A * | 12/1996 | Rose | G10D 3/14 | 84/297 R |
| 5,986,191 | A * | 11/1999 | McCabe | G10D 3/146 | 84/313 |
| D496,385 | S * | 9/2004 | Steinberger | D17/20 | |
| 7,470,841 | B1 * | 12/2008 | McCabe | G10D 3/146 | 84/312 R |
| 8,536,430 | B2 * | 9/2013 | McCabe | G10D 3/14 | 84/312 R |
| 8,952,231 | B1 * | 2/2015 | Gonzalez | G10D 1/085 | 84/297 R |
| 9,123,312 | B2 * | 9/2015 | McCabe | G10D 3/146 | |
| 2015/0068385 | A1 * | 3/2015 | Oliver | G10D 3/14 | 84/304 |

FOREIGN PATENT DOCUMENTS

| | | | | |
|---|---|---|---|---|
| GB | 2188765 | A * | 10/1987 | G10D 3/14 |

* cited by examiner

*Primary Examiner* — Robert W Horn

(57) ABSTRACT

The present invention relates to a axial movement tuner that pulls an instrument string in any direction within hemispherical space where the string exits the tuner. The tuner is an adjusting thumbscrew that has a through borehole for string passage and a low friction bearing recessed within the thumbscrew knob, where instrument strings are installed by simply passing them through the thumbscrew bearing, on through the hole in the thumbscrew, and out through a horn shaped opening. Ball end string movement is stopped when the ball reaches the small diameter bearing hole. Tuning is accomplished by turning the thumbscrew causing axial movement of the string end ball while the bearing limits string rotation, and this axial movement of the string within the tuner is redirected by a smooth horn shaped opening to any direction within a hemispherical space defined by the tuner string exit opening.

18 Claims, 11 Drawing Sheets

STRINGED INSTRUMENT HEMISPHERICAL PULL STRING TENSIONER

FIELD OF THE INVENTION

The present invention relates to tuning of a string in a stringed musical instrument, particularly to a stringed instrument comprising of a hemispherical pull string tensioning mechanism.

BACKGROUND OF THE INVENTION

The invention of stringed instruments automatically required the invention of string tensioning devices for tuning the instrument. The conventional tuners used were made of wooden pegs, with a knob on one end. They also had a hole for string holding and fastening on the other end, that were inserted into a hole in a headstock at the end of the instrument neck. The string wrapped around the peg as the knob was turned and friction between the hole and the peg held it in place after tuning. Improvements followed with the invention of metal worm gear tuners that provided more precise adjustment and no peg slippage problems. Many other gearing configurations and enhancements followed worm gear tuners as discussed in U.S. Pat. No. 2,955,503A.

Most tuners are still mounted on a headstock at the end of the instrument neck, but more compact instruments have been developed that eliminated the headstock and moved the tuners to the other end of the strings somewhere on the body of the instrument. Conventional peg and worm gear tuners are difficult to fit onto the instrument body geometry.

Axial (or linear) pull tuners were invented to better fit the instrument body geometry as discussed in U.S. Pat. No. 5,103,708A. However, most available axial pull tuners are complex, some are large and limited in mounting options, and some have poor string clamping ability.

The peg and worm gear tuners are limited in pull direction to a single 360 degree plane that is perpendicular to the string attachment peg. Axial pull tuners in general are limited in pull direction to mostly in line with the tuner axis.

Thus, in the light of the above discussion there seems to be a need for an invention that provides an improvement over previous axial pull tuners and provides comparable performance with worm gear tuners.

OBJECT OF INVENTION

The principal object of the invention herein is to provide an improved hemispherical pull string tension mechanism that can pull the string in any direction on a 360 degree plane perpendicular to the tuner axis.

Another object of the present invention is to provide a device that can pull in any direction defined by a hemisphere between the 360 degree plane and the axial pull line.

Another object of present invention is to provide a device that is simple and compact having a wide range of installation options to accommodate instrument body geometry.

SUMMARY OF THE INVENTION

According to the present invention the device comprises of a receiving component with an internally threaded borehole. This component is mounted on the instrument body or headstock. The exit mouth of the borehole has a smooth horn shaped opening that allows the string to transition from the axial direction to any direction defined by the previously mentioned hemisphere.

The receiving component can be a single receiving component so there is a one-to-one relationship between it and the externally threaded rotating component. Or the receiving component can have multiple internally threaded boreholes with horn shaped exits, which can receive multiple externally threaded rotating components so there is a one-to-many relationship.

The device is further comprised of an externally threaded rotating component that screws into the instrument body mounted receiving component. This component has an axially centered smooth borehole for instrument string passage. It has a knob, also with a smooth borehole for string passage that is turned for tuning adjustments.

The device is further comprised of a low friction component attached to the end of the knob. This low friction component provides for attachment of the string that passes through both previously described components. The purpose of the low friction component is to allow the rotating component to turn for tension adjustment while the string rotation remains inconsequential. When used without ball end strings an auxiliary string terminator component is mated with the low friction component.

BRIEF DESCRIPTION OF THE DRAWINGS

In the accompanying figures, similar reference numerals may refer to identical or functionally similar elements. These reference numerals are used in the detailed description to illustrate various embodiments and to explain various aspects and advantages of the present disclosure.

DETAILED DESCRIPTION OF THE INVENTION

These and other features of the present invention will become readily apparent upon further review of the following specification and drawings. Other goals and advantages of the invention will be further appreciated and understood when considered in conjunction with the following description and accompanying drawings. While the following description may contain specific details describing particular embodiments of the invention, this should not be construed as limitations to the scope of the invention but rather as an exemplification of preferable embodiments. For each aspect of the invention, many variations are possible as suggested herein that are known to those of ordinary skill in the art. A variety of changes and modifications can be made within the scope of the invention without departing from the spirit thereof.

The following detailed description is intended to provide example implementations to one of ordinary skill in the art, and is not intended to limit the invention to the explicit disclosure. As one of ordinary skill in the art will understand, variations can be substituted that are within the scope of the invention as described.

The primary unique attributes of this invention are: the ability to tension an instrument string with a linear motion rotating component that includes a borehole for string passage and a low friction component to which the string is attached that allows the rotating component to rotate while the instrument string does not rotate. It further comprises a horn shaped exit in the receiving component that translates the rotating component axial pull into a pull in any direction within the hemisphere defined by the horn exit.

The device of the present invention can be configured in a one-to-one configuration with one rotating component and one receiving component per device, or the device can have a one-to-many configuration with multiple rotating components and one receiving component per device. While only one implementation of each configuration will be described, there are many other design variations that could be used to implement the basic principles of this invention.

Figure 1:
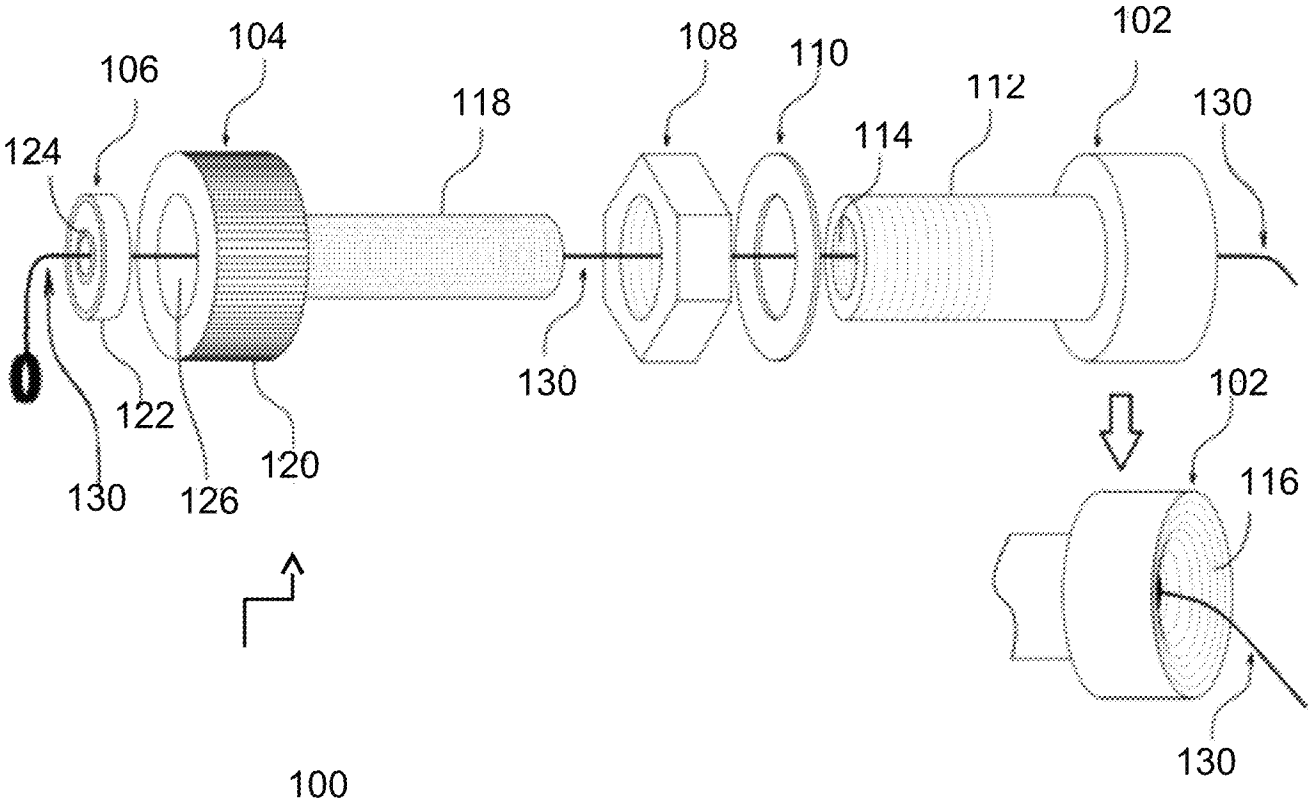
FIG. 1 illustrates the disassembled perspective view of the tuner in a one-to-one configuration according to the present invention.
Figure 2:
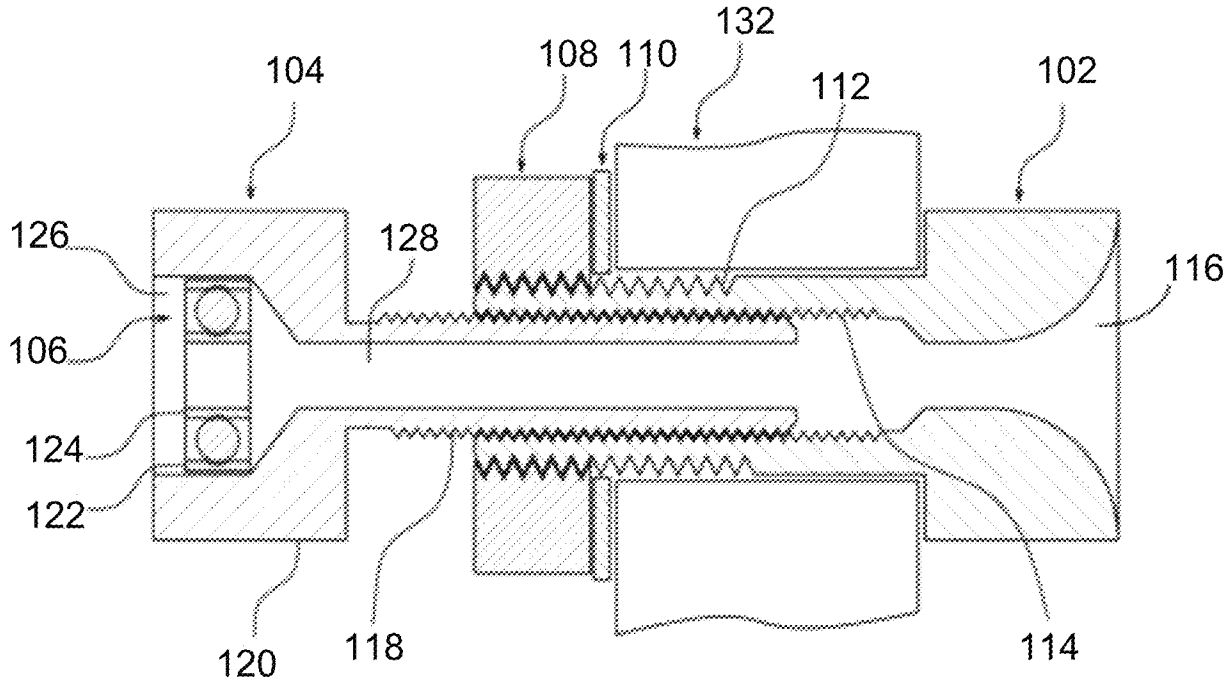
FIG. 2 illustrates the cross-sectional view of the assembled tuner in a one-to-one configuration.

FIG. 1 shows a disassembled perspective view and FIG. 2 shows an assembled cross sectional drawing of a one-to-one implementation of the tuning device 100. The receiving component 102 is rigidly attached to either the instrument headstock or body depending on the instrument configuration, and the rotating component 104 with its low friction component 106 engages the internally threaded receiving component to provide axial movement of the instrument string end 130 to tune the instrument.

FIG. 2 shows mechanism of the receiving component 102 being attached to the instrument body or headstock 132. The smaller exterior diameter 112 of the receiving component 102 is inserted through a borehole in the instrument. The receiving component 102 is held rigidly in place by tightening a nut 108 with a washer 110 onto the threaded portion of the smaller exterior diameter 112 of the receiving component 102.

Furthermore, FIG. 2 also shows the rotating component 104 engaging with the receiving component 102. The external threads 118 of the rotating component 104 screw into the matching internal threads 114 of the receiving component 102. As the rotating component 104 turns, the threads 114 and 118 cause the rotating component 104 to move axially with respect to the receiving component 102.

As shown in FIG. 2 the low friction component 106 is inserted into a shallow borehole 126 in the rotating component 104. The outer part 122 of the low friction component 106 is held permanently in place in the shallow borehole 126 by an interference fit or by an adhesive.

FIG. 1 illustrates a string 130 being installed with the present invention. The string 130 in this case is a ball end string. With the rotating component 104 fully engaged in the receiving component 102, the open end of the string 130 is inserted through the bore of the inner part 124 of the low friction component 106. The string continues on through a bore 128 in the rotating component 104 and exits through a horn shaped opening 116 in the receiving component 102. The string 130 is then pulled fully through this tuning device until the ball end is stopped by the lesser diameter bore of the inner part 124 of the low friction component 106. The open end of the string 130 is then fastened by some means not discussed here to the other end of the instrument 132. Tuning of the string 130 is then accomplished by grasping the friction increasing surface 120 of the rotating component 104 and turning the rotating component 104. This action causes the rotating component 104 to move axially to create the proper tension in the string 130. Rotation of the string ball end is minimized by minimal rotation of the inner part 124 of the low friction component 106.

Figure 3:
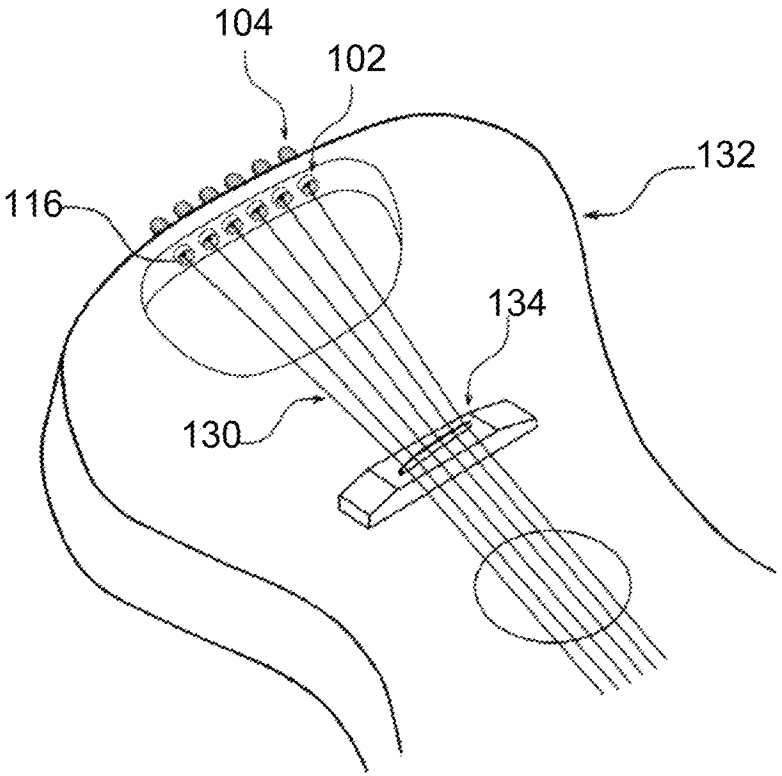
FIG. 3 illustrates the perspective view of a sample installation of the one-to-one configured tuners in an instrument body.

FIG. 3 illustrates an example of several tuning devices being installed on the body of a headless guitar 132. The receiving component 102 is mounted in a borehole through the wall of a recessed cavity in the guitar body 132, and the rotating component 104 is screwed into the receiving component 102 from the outside of the guitar body 132. The guitar strings 130 are inserted into the rotating component 104 and exit through the horn shaped opening 116 of the receiving component 102. The strings proceed across the saddle 134 and then up the neck. The neck (not shown in the Figure) would have some type of string clamping device at the end of the neck where the headstock will normally be situated.

Figure 4:
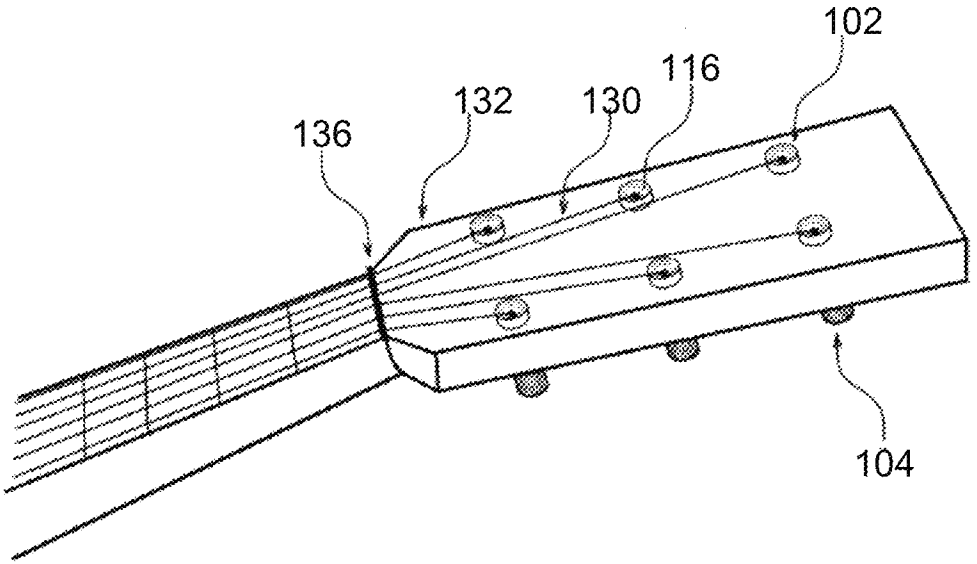
FIG. 4 illustrates the perspective view of a sample installation of the one-to-one configured tuners in an instrument headstock.

Further, FIG. 4 also shows an example of several tuning devices being installed on the headstock of a guitar. The receiving component 102 is mounted in a borehole through the headstock of the guitar 132, and the rotating component 104 is screwed into the receiving component 102 from underneath the guitar headstock 132. The guitar strings 130 are inserted into the rotating component 104 from underneath the guitar headstock 132 and exit through the horn shaped opening 116 of the receiving component 102. In this case, the guitar strings 130 follow the curvature of the horn shaped opening 116 of the receiving component 102 and proceed away from the tuning device in a direction that is perpendicular to the axis of the tuning device. The guitar strings 130 proceed across the nut 136 at the end of the guitar neck and down the neck. While not pictured, the guitar strings 130 would proceed down the neck and across the saddle to some type of string clamping device at the base of the guitar body 132.

Figure 5:
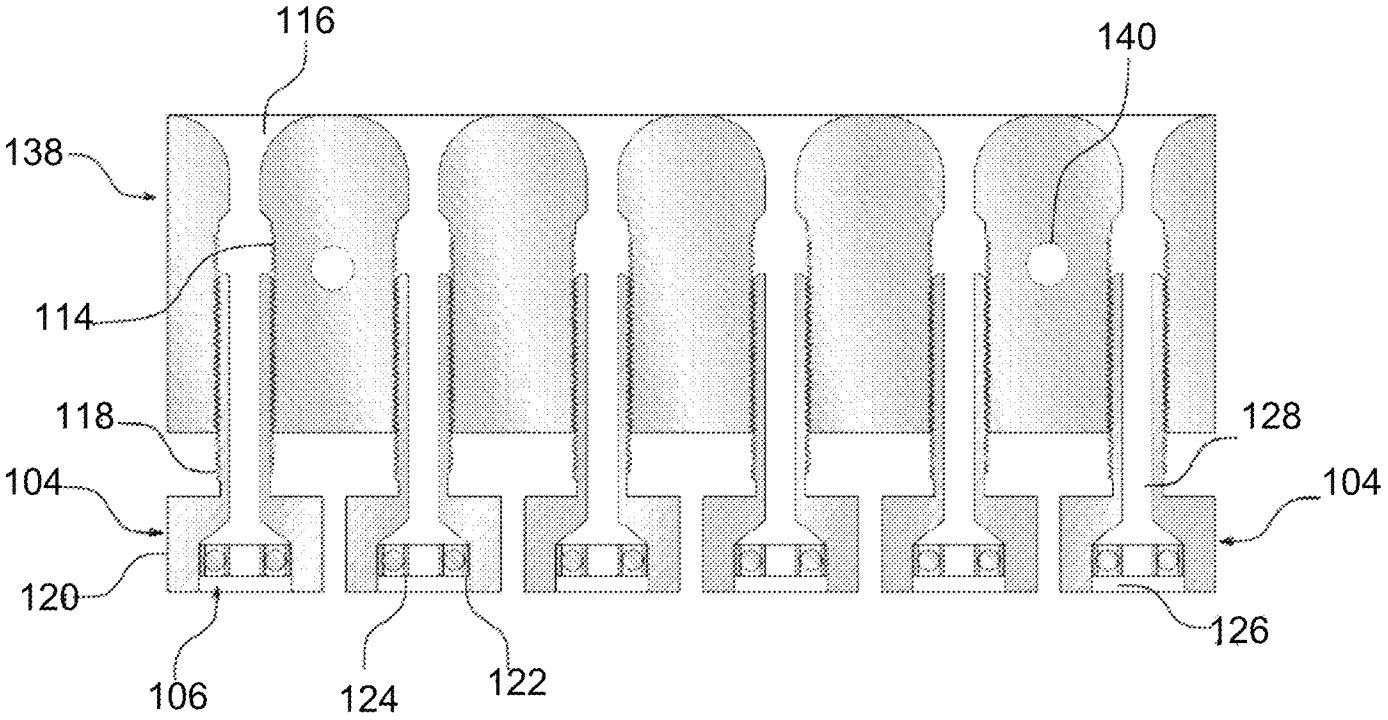
FIG. 5 illustrates the cross-sectional view of the assembled tuner in a one-to-many configuration.

FIG. 5 shows an assembled cross sectional drawing of a one-to-many implementation of the tuning device with one receiving component 138 configured to accept multiple rotating components 104. The receiving component 138 has multiple threaded boreholes 114 with corresponding horn shaped exits 116. The position and orientation of these multiple threaded boreholes 114 and horn shaped exits 116 within the receiving component 138 can be varied to accommodate the geometry of the instrument with which it will be used. The receiving component 138 may contain one or more mounting boreholes 140 to accommodate instrument attachment with screws or bolts. Each threaded borehole 114 receives one rotating component 104. The rotating components 104 in the one-to-many configuration are identical to those already described in the one-to-one configuration.

Figure 6:
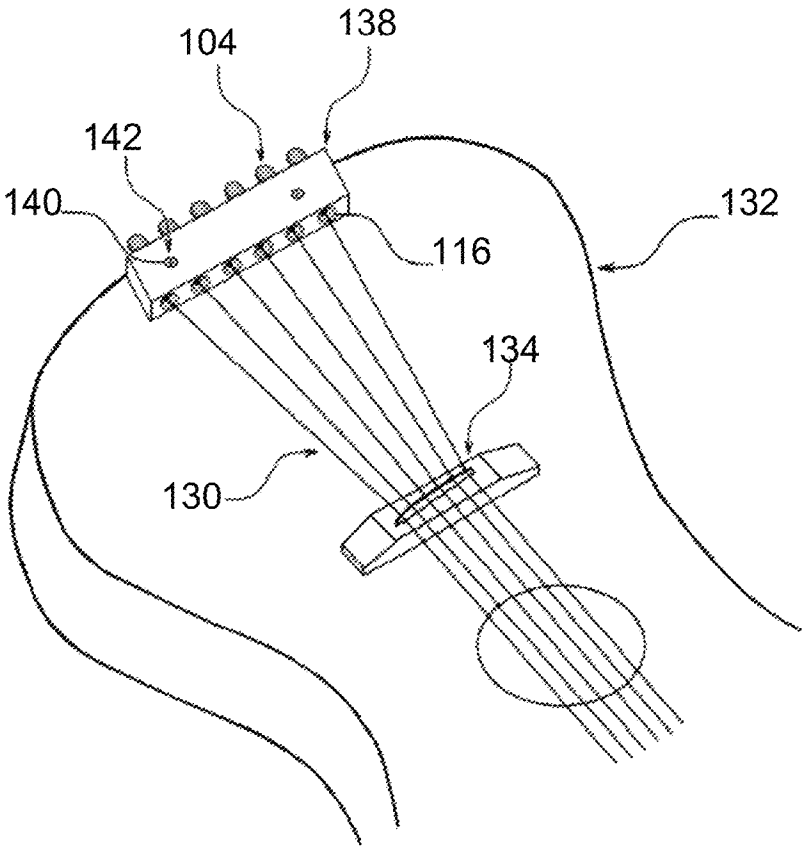
FIG. 6 illustrates the perspective view of a sample installation of the one-to-many configured tuner on an instrument body.

FIG. 6 shows an example of a one-to-many tuning device being installed on the body of a headless guitar 132. The receiving component 138 is mounted on the body of the guitar 132 using screws 142 inserted into the mounting boreholes 140, and the rotating components 130 are screwed into the receiving component 138. The guitar strings 130 are inserted into the rotating components 104 and exit through the horn shaped openings 116 of the receiving component 138. The strings proceed across the saddle 134 and then up the neck. The neck, which is not pictured, would have some type of string clamping device at the end of the neck where the headstock normally be situated.

Figure 7:
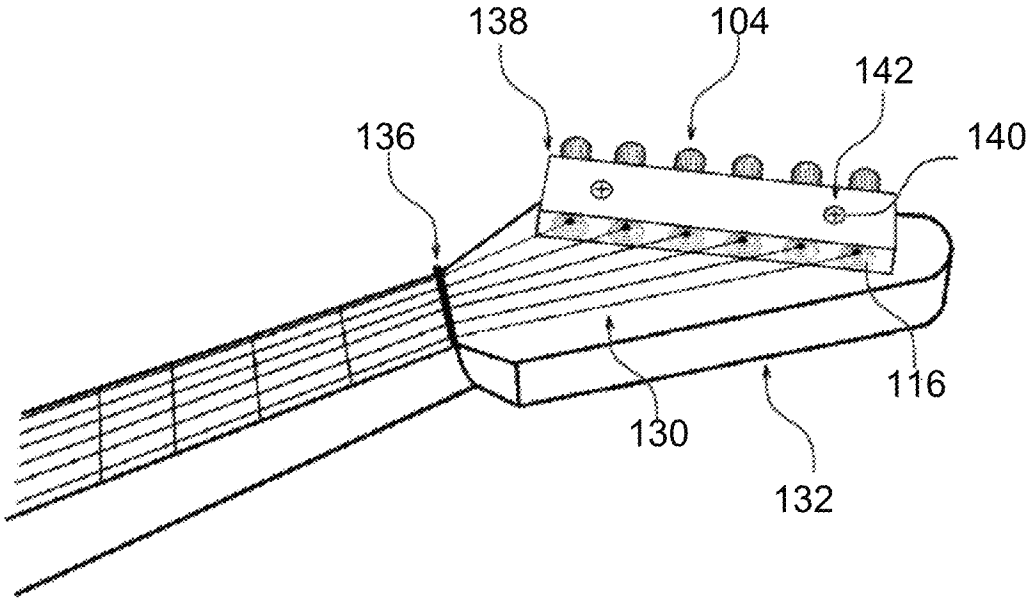
FIG. 7 illustrates the perspective view of a sample installation of the one-to-many configured tuner in an instrument headstock.

FIG. 7 also shows an example of how a one-to-many tuning device might be installed on the headstock of a guitar 132. The receiving component 138 is mounted on the headstock of a guitar 132 using screws 142 inserted into the mounting boreholes 140, and the rotating components 104 are screwed into the receiving component 138. The guitar strings 130 are inserted into the rotating components 104 and exit through the horn shaped openings 116 of the receiving component 138. In this case, the guitar strings 130 follow the curvature of the horn shaped openings 116 of the receiving component 138 and proceed away from the tuning device in a direction that is almost perpendicular to the axis of the tuning device. The guitar strings 130 proceed across the nut 136 at the end of the guitar neck and down the neck. While not pictured, the guitar strings 130 would proceed down the neck and across the saddle to some type of string clamping device at the base of the guitar body 132.

Figure 8:
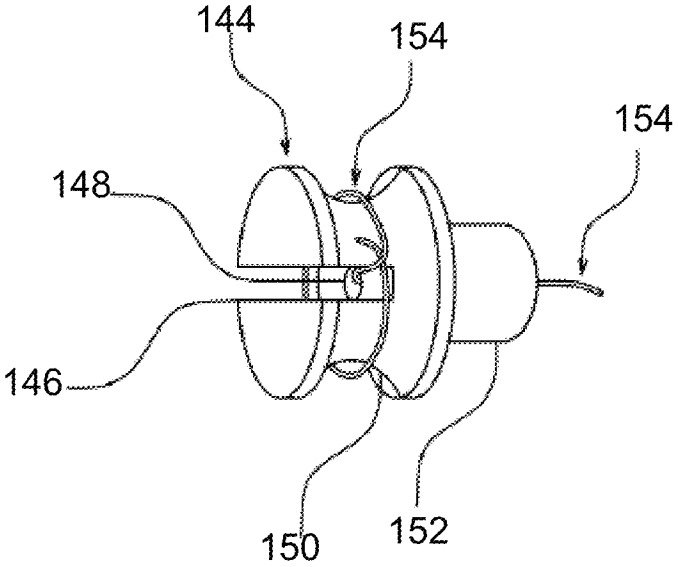
FIG. 8 illustrates the perspective view of an auxiliary string terminator component for use with non-ball end strings according to one embodiment of the present invention.

FIG. 8 shows a perspective drawing of the auxiliary string terminator component 144 according to one embodiment, which has a slotted end and a low friction component mating end 152. The auxiliary string terminator component 144 is used to attach non-ball end strings 154. It has a borehole 148 through which the instrument string 154 passes. A slot 146 on the slotted end allows the string 154 to be bent a right angle as it exits the borehole 148, and then wound around a spool shaped groove 150 that wraps around the slotted end of the auxiliary string terminator 144. The string 154 is wrapped under itself one or more times as it is wound around the spool shaped grove 150 one or more times to provide a friction grip of the string 154 on the auxiliary string terminator 144.

Figure 9:
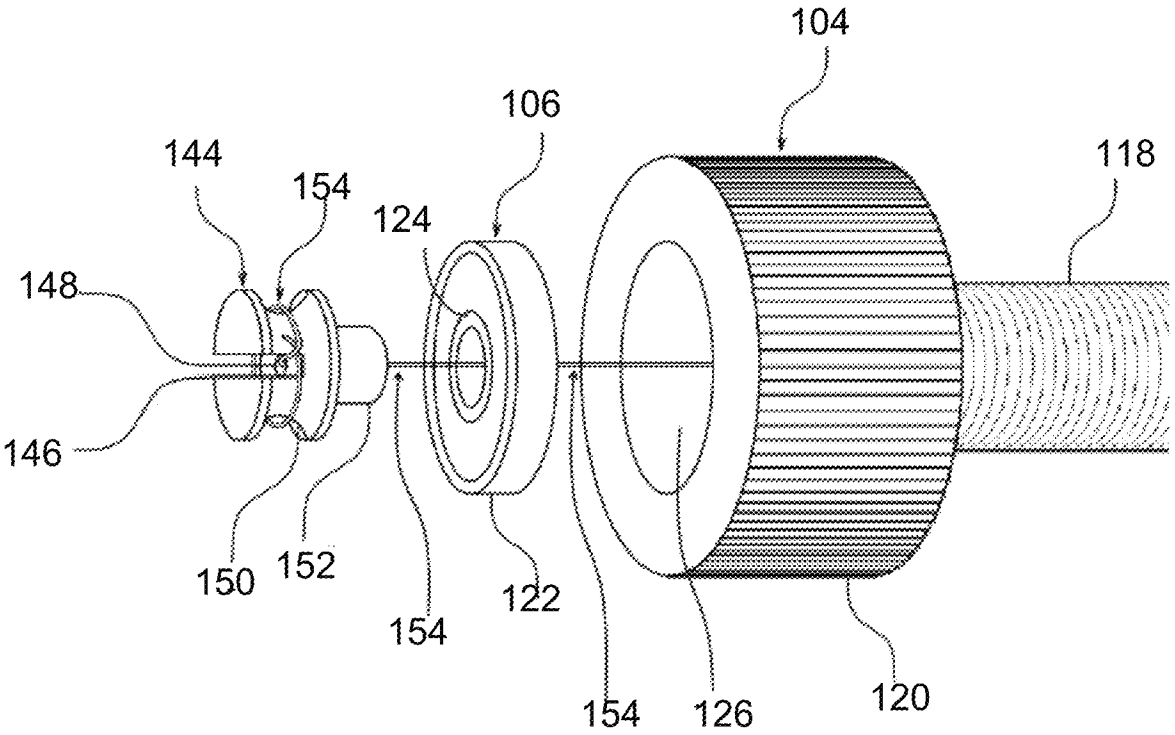
FIG. 9 illustrates the perspective view of the auxiliary string terminator component being placed with respect to the low friction and rotating components according to one embodiment of the present invention.

FIG. 9 shows a disassembled perspective drawing of the relationship of the auxiliary string terminator 144 according to one embodiment, to the low friction component 106 and the rotating component 104, as well as the non-ball end instrument string 154 routing through these components. It was previously explained that the low friction component 106 is mounted in the shallow borehole 126 in the rotating component 104. The cylindrical low friction component mating end 152 of the auxiliary string terminator component 144 slips into the inner part 124 of the low friction component 106. The non-ball end instrument string 154 passes through the center of the rotating component 104, the low friction component 106, and the auxiliary string terminator 144, where it wraps around the spool shaped groove 150 of the auxiliary string terminator 144 as previously explained.

Figure 10:
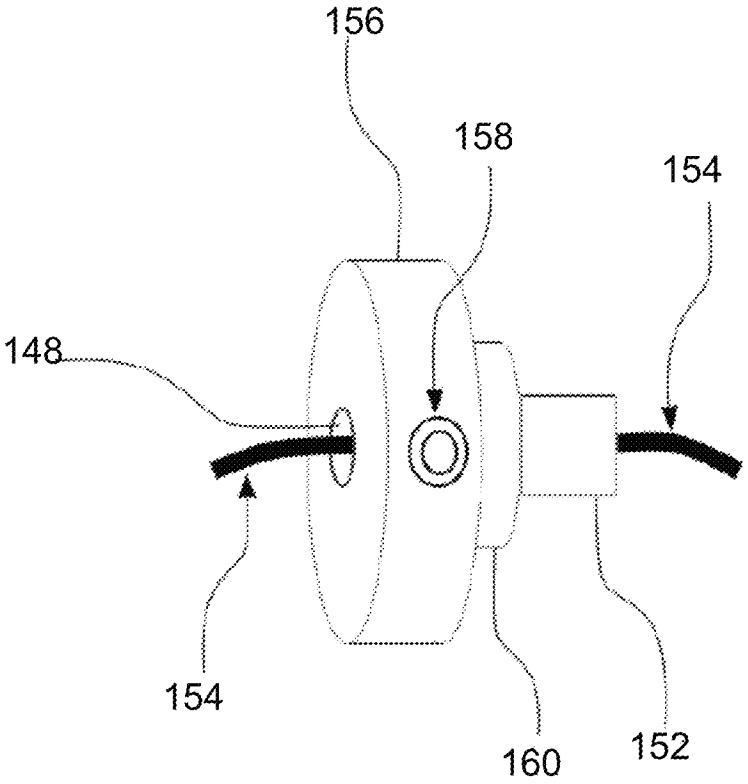
FIG. 10 illustrates the perspective view of an auxiliary string terminator component for use with the non-ball end of the string according to another embodiment of the present invention.

FIG. 10 shows a perspective drawing of the auxiliary string terminator collar 156, which uses set screw and a low friction component mating end 152. The auxiliary string terminator collar 156 is used to attach non-ball end strings 154. It has a borehole 148 through which the instrument string 154 passes. A set screw 158 presses against the borehole 148 to provide a friction grip on the string 154. The collar 156 rests on the rotating component 106 with spacing provided by flange 160.

Figure 11:
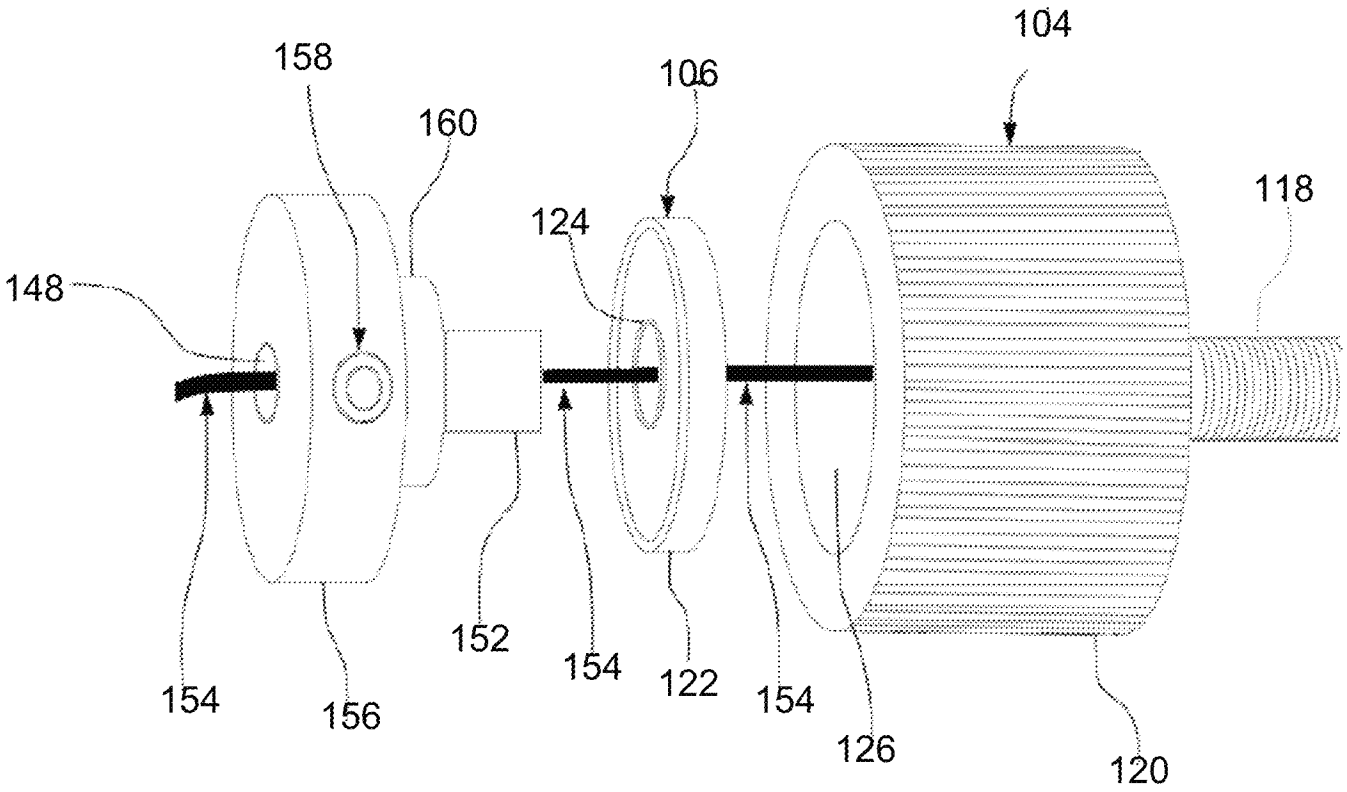
FIG. 11 illustrates the perspective view of the auxiliary string terminator component being placed with respect to the low friction and rotating components according to another embodiment of the present invention.

FIG. 11 shows a disassembled perspective drawing of the relationship of the auxiliary string termination collar 156 to the low friction component 106 and the rotating component 104, as well as the non-ball end instrument string 154 routing through these components. It was previously explained that the low friction component 106 is mounted in the shallow borehole 126 in the rotating component 104. The cylindrical low friction component mating end 152 of the auxiliary string terminator collar component 156 slips into the inner part 124 of the low friction component 106. The non-ball end instrument string 154 passes through the center of the rotating component 104, the low friction component 106, and the auxiliary string terminator collar 156, where it is held in place by friction provided by the set screw 158.

Although an illustrative embodiment of the invention has been shown and described, it is to be understood that various modifications and substitutions may be made without departing from the novel spirit and scope of the present invention.

What is claimed:

1. A hemispherical pull tuning device for tuning a stringed instrument comprising;

an instrument attached receiving component with one or more boreholes that are internally threaded on one end and horn shaped on the other end;

a rotating component with external threads on one end for engaging an internally threaded receiving component borehole, and having a knob on the other end for user activated rotation;

where the rotating component consists of a small diameter through borehole, and a larger diameter shallow borehole on the knob end;

a low friction component that permanently resides in the shallow borehole in the knob end of the rotating component, that supports one end of an instrument string and allows the rotating component to turn while the supported string incurs minimal rotation; and an auxiliary non-ball end string terminator component which provides for string attachment to the tuner when non-ball end strings are used.

2. The hemispherical pull tuning device of claim 1, wherein the borehole horn shaped end provides a large radius curvature exit path for the instrument string to exit the tuning device in any direction defined by a hemisphere, opposite to the horn shaped opening, which redirects the string pull with minimal bending stress on the string.

3. The hemispherical pull tuning device of claim 2, wherein the borehole horn shaped exit curvature profile can be any geometric shape, including but not limited to circular, parabolic, or elliptical, that has a large enough radius at all points along the curve to prevent sharp bending of the exiting instrument string.

4. The hemispherical pull tuning device of claim 1, wherein the internal threads of the receiving component mate with the external threads of the rotating component to provide axial movement of the rotating component upon rotation.

5. The hemispherical pull tuning device of claim 4, wherein the internal threads of the receiving component and the external threads of the rotating component may be of any thread style, pitch, or left or right hand.

6. The hemispherical pull tuning device of claim 1, wherein a single borehole receiving component can be attached to the instrument by any means, including but not limited to:

external threads on the receiving component that screw directly into a borehole in the instrument;

external threads on the receiving component which receive a nut that is tightened to clamp the receiving component in a borehole in the instrument, a flange on the receiving component with holes for screw attachment to the instrument, or direct adhesive attachment to the instrument.

7. The hemispherical pull tuning device of claim 1, wherein a receiving component with multiple boreholes can have the holes arranged in any pattern or orientation to accommodate the geometry of the instrument.

8. The hemispherical pull tuning device of claim 1 wherein a receiving component with multiple boreholes can be attached to the instrument by any means, including but not limited to:

screws or bolts that are inserted through mounting boreholes in the receiving component body or through;

flanges attached to the body, or by direct adhesive attachment.

9. The hemispherical pull tuning device of claim 1, wherein the receiving component with multiple boreholes can receive multiple rotating components with attached low friction components.

10. The hemispherical pull tuning device of claim 1, wherein the knob on the rotating component knob end can be of any shape including but not limited to circular or paddle shaped.

11. The hemispherical pull tuning device of claim 9, wherein the knob may have a friction increasing surface to enhance the user grip on the knob.

12. The hemispherical pull tuning device of claim 1, wherein the low friction component may be of any type, including but not limited to:

ball bearings, tapered bearings, roller bearings, and lubricated or slick surfaces with no rolling bearings.

13. The hemispherical pull tuning device of claim 1, wherein the low friction component is held in place in the rotating component knob end shallow borehole by an interference fit or by an adhesive.

14. The hemispherical pull tuning device of claim 1, wherein the inner borehole of the low friction component supports one instrument string end, either by having a smaller diameter than the ball on a ball end type instrument string, or by using an auxiliary string terminator component.

15. The hemispherical pull tuning device of claim 13, wherein the auxiliary string terminator component has a cylindrical smaller diameter end which mates with the inner borehole of the low friction component.

16. The hemispherical pull tuning device of claim 14 wherein the auxiliary string terminator component has an inner borehole for instrument string passage.

17. The hemispherical pull tuning device of claim 14 wherein the auxiliary string terminator component has a slotted end which allows the instrument string to be bent at right angles to its borehole.

18. The hemispherical pull tuning device of claim 14 wherein the auxiliary string terminator component has a spool shaped groove around the slotted end around which the instrument string is wrapped and secured by friction.

* * * * *